United States Patent [19]

Babcock et al.

[11] 4,111,146

[45] Sep. 5, 1978

[54] TANK SUPPORT JOINT

[75] Inventors: Robert A. Babcock, Duxbury; Rolf D. Glasfeld; Luther E. Holt, both of Cohasset, all of Mass.

[73] Assignee: General Dynamics Corporation, St. Louis, Mo.

[21] Appl. No.: 809,110

[22] Filed: Jun. 22, 1977

[51] Int. Cl.[2] ..... B63B 25/12

[52] U.S. Cl. ..... 114/74 A; 220/901

[58] Field of Search ..... 114/74 R, 74 A; 220/9 A, 9 LG; 248/DIG. 1; 156/245, 304; 264/261, 271, 262, 267

[56] References Cited

U.S. PATENT DOCUMENTS

| | | | |
|---|---|---|---|
| 3,834,174 | 9/1974 | Strumbos | 114/74 A X |
| 3,872,198 | 3/1975 | Britton | 264/271 X |
| 3,894,505 | 7/1975 | Murphy | 114/74 A |

*Primary Examiner*—Trygve M. Blix
*Assistant Examiner*—Sherman D. Basinger
*Attorney, Agent, or Firm*—Fitch, Even, Tabin & Luedeka

[57] ABSTRACT

A two-piece skirt is disclosed for supporting a tank in the hull of a ship. One skirt portion carries a trough, and the edge of the other skirt portion extends into the trough but is spaced from contact therewith. The trough is filled with a hardenable material, preferably of low thermoconductivity, which upon hardening structurally joins the two skirt portions. If the tank carries liquefied gas, the joint effectively thermally insulates it from the hull.

10 Claims, 3 Drawing Figures

TANK SUPPORT JOINT

The present invention relates generally to marine vessels for transporting liquefied gas and more particularly to the means for attaching liquefied gas tanks within the hulls of seagoing vessels.

The trans-oceanic shipment of liquefied gases has recently become practically and economically feasible. In particular, the shipment of liquefied natural gas (LNG) has received increasing interest as world energy supplies dwindle and costs increase. Most often, these liquefied gases are shipped at low pressures and cryogenic temperatures, e.g., natural gas liquefies at about −162° C at atmospheric pressure. The liquefied gas is usually contained in tanks or compartments secured with the hull of the ship or vessel.

One technique which has been used to mount liquefied gas tanks in the hull of a ship is described in U.S. Pat. No. 3,680,323 to Bognaes, et al, entitled "Tanker for Liquified and/or Compressed Gas." That patent discloses a spherical tank which is mounted in a hull by an annular skirt which extends between the equatorial line of the tank and a lower deck in the hull. Other techniques for mounting tanks within vessels may be found in U.S. Pat. Nos. 3,425,583 to Bridges and 3,941,272 to McLaughlin.

An object of the present invention is to provide an improved structure for supporting liquefied gas tanks within a ship's hull. Another object of the present invention is to provide an improved means for securing an annular tank skirt in the hull of a ship.

Figure 1:
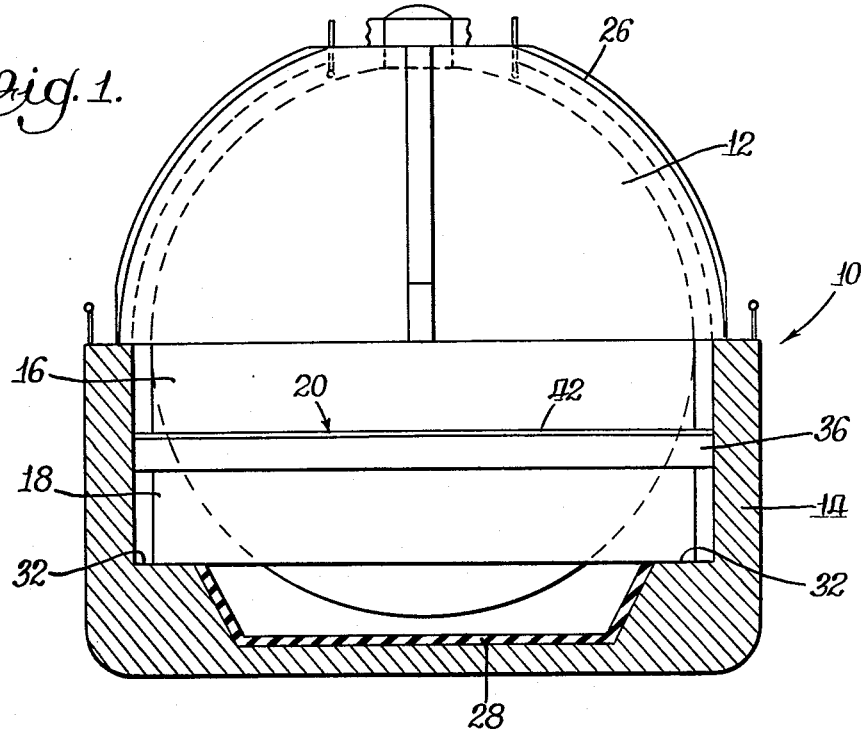
Figure 2:
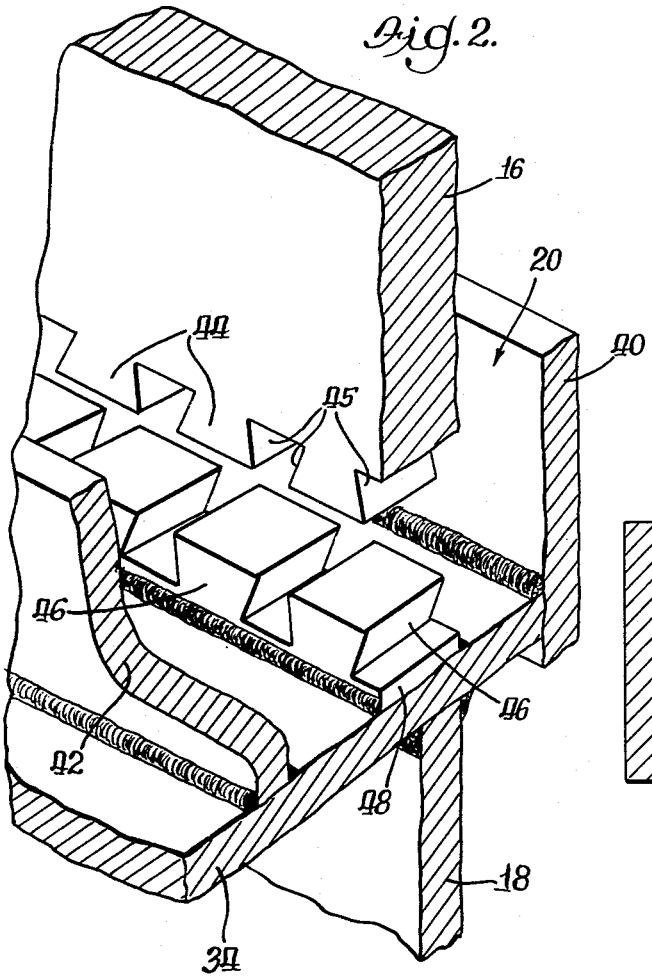
Figure 3:
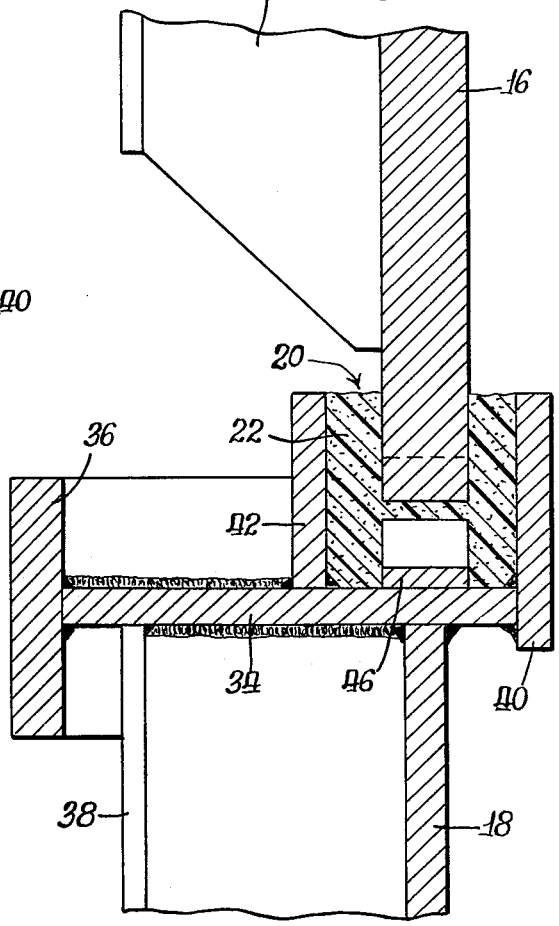

These and other objects of the present invention will be evident from reading the following detailed description with the attached drawings, of which, FIG. 1 is a cross-sectional view of a ship for carrying liquefied gases which embodies the present invention;

FIG. 2 is a perspective view, partially broken away and in section, showing a tank skirt which embodies the present invention; and FIG. 3 is a cross-sectional view of the tank skirt of FIG. 2.

The present invention is generally embodied in a seagoing vessel 10 which carries at least one tank 12 for containing and transporting liquefied gases. The tank is mounted within the hull 14 by a support structure comprising a two-piece annular skirt. The upper portion 16 of the two-piece skirt is attached around the periphery of the tank, and the lower portion 18 of the skirt is attached to the hull of the vessel. In accordance with the present invention, the edge of the upper skirt is suspended in a trough, generally 20, carried on the lower skirt. The trough is filled with a hardenable material 22 which imbeds the edge of the upper skirt and, when the material hardens, rigidly secures the skirt portions together. The hardened material is preferably of substantially lower thermal conductivity than the skirt portions thereby also insulating the low-temperature tank from the ambient ocean temperature of the hull.

Turning now to a more detailed description of the preferred embodiment of the present invention, which is shown in the attached drawings, a typical vessel 10 may have five or more tanks 12 mounted in-line in the hull 14. Each tank is spherical and may be fabricated from a variety of materials, such as aluminum plate. A typical tank may have a diameter of 120 feet and weigh up to 850 tons. Because of the large size, the upper portion of the tank extends above the main deck of the ship, and a weather cover 26 is provided to seal the tank and hull against the elements. At a location directly below each tank, the hull may be provided with a catch basin lined with foam insulation 28. In the unlikely event of leakage, the liquefied gas can collect in the basin, where it is protected from direct contact with the hull until it vaporizes.

As described briefly earlier, each tank is mounted within the hull by a two-part skirt. The upper portion 16 of the skirt is a wide ring or cylinder, thick enough to support the weight of the tank and to resist the stresses which arise from rolling and heaving of the ship during an ocean voyage. Vertical stiffeners 30 may also be welded to the outside surface of the ring to increase its strength. The upper edge of the skirt is attached around the equator of the tank, and the tank may include a radially or tangentially extending flange (not shown) to which the upper edge of the skirt is connected. The flange may be bolted to the skirt or welded if the upper portion and the tank are of the same material, such as aluminum.

The lower portion 18 of the skirt is also a wide ring or cylinder of approximately the same diameter as the upper portion 16. It is preferably of steel construction and is welded to a lower deck 32 in the hull of the ship. A flat, arcuate, mounting plate 34, which may also be described as a horizontal or flat ring, is welded along the upper edge of the lower skirt portion and extends radially outwardly and inwardly from the skirt. To help stabilize and stiffen the lower skirt portion so that it can adequately support the huge tank under sea-going conditions, a vertical ring stiffener 36 is welded along the outer edge of the mounting plate. Vertical stiffeners 38 similar to the stiffeners 30 are welded to the outer surface of the lower skirt portion and may extend downward to the lower deck. With this construction, sufficient strength is provided in the lower skirt portion so that braces or struts between the two skirt portions are not required.

To secure the tank 12 during the tossing and rolling of a sea-going voyage, the two skirt portions must be rigidly connected. To this end, the trough 20 is provided atop the lower skirt portion, and upper surface of a portion of the flat mounting plate 34 forms the bottom of the annular trough. The inner side wall of the trough is provided by a vertical ring 40 which is welded to the inside edge of the mounting plate, and the outer side wall is formed by a concentric vertical ring 42, which is welded to the upper surface of the mounting plate.

The skirt portions are actually joined by inserting the upper skirt portion into the trough and filling the trough with the hardenable material 22 until it embeds the lower edge of the upper skirt portion. When the material hardens, the skirt parts are rigidly secured together. Preferably, the upper skirt portion is suspended in the trough out of physical contact with any part of the trough, and a hardenable material is selected having a thermal conductivity lower than the skirt portions. Thus, after the trough is filled and the material hardens, the skirt portions are in fact mechanically connected, but yet relatively thermally isolated. This is particularly important with the shipment of liquefied gases at cryogenic temperatures, where heat transfer to the tank will cause loss through boil-off. In ships, the hull and the lower skirt portion near the hull will generally be at the ambient temperature of the ocean, and the tank and upper skirt portion near the tank will be at about the cryogenic temperature of the tank contents. When the tank skirt portions are actually contacting each other, heat is directly conducted through the metal skirt to the tank. With the present invention, the hardened material interrupts the conduction of heat along the skirt by insulating the joint between the two skirt portions.

The preferred hardenable material is a polymeric resin of low thermal conductivity, such as an epoxy resin or polyurethane resin system, which is initially fluid, so that it may be poured into the trough, but subsequently hardens to embed the upper skirt in a solidified mass of high-strength resin. The preferred material is an epoxy resin which may include appropriate fillers or the like. One satisfactory epoxy resin is that sold by Philadelphia Resin Corporation under the trade designation Chockfast Grey, Modified, which when polymerized using the prescribed hardener has a thermal conductivity of about 0.4 BTU/hr. ft.° F., compared to about 26 for steel, and about 65 for aluminum. Epoxy resins have a further advantage in that they have strong adhesive properties for gripping the surfaces of the upper skirt portion and trough.

To help anchor the skirt portions to the hardened material, each portion has anchoring means in the form of a series of undercut lugs which become embedded in the hardened material. In the preferred embodiment, a series of downwardly-extending and inversely-tapered or dovetailed lugs 44 are provided along the lower edge of the upper skirt portion 16. The lugs have flat side surfaces 45 which converge upwardly to undercut the bottom end of the lug and to form a narrower neck where the lug meets the remainder of the skirt. This provides an upwardly diverging slot or keyway between adjacent lugs which becomes filled with resin. An annular bar which has similar dovetail lugs 46 upstanding from a flat base ring 48 is welded to the mounting plate 34 in the bottom of the trough.

The tank is positioned with the lower edge of the upper skirt extending into the trough 20 with downwardly extending lugs 44 spaced slightly above the upstanding lugs 46. Usually the upper skirt portion is already welded to the tank, and the tank is lowered slowly into the hull by an overhead crane. The upper skirt portion 16 is centered so it is spaced from direct physical contact with the trough walls 40,42. While the upper skirt portion 16 is stably supported in this position, the thermosetting resin system or other hardenable material is poured into the trough 20 in a liquid or semi-liquid state until the trough is filled to a level above the lower edge of the lugs 44 in the upper skirt portion, and preferably until each entire lug in the upper skirt portion is covered and resin completely fills the keyways between adjacent lugs.

After the resin hardens, the lugs 44,46 of both upper and lower skirt portions are firmly anchored in a solid resin ring. Although the ship may undergo a wide variety of motions during an ocean voyage, which may result in complex sets of forces being applied to the tanks, when mounted as described above, the tanks are nevertheless securely held in the hull. Since the lugs of both upper and lower skirt portions are embedded in a solid resin, the tank and upper skirt portion are restrained against vertical shifting or movement by engagement between the converging side surfaces of the undercut lugs and the hardened resin therebetween. Lateral shifting of the tank and the upper portion of the skirt is prevented because the resin totally fills the inner and outer regions between the lugs 44 and the upstanding side walls 40,42 of the trough. The adhesion of the resin to the surfaces of the lugs further stabilizes against movement in the vertical direction.

In the preferred embodiment, the lugs are dovetailed for firm anchoring in the resin, but some other shape or configuration, whether undercut or not, which would firmly anchor the skirt, for example, a series of radial pegs, may also be used. Instead of using an annular bar in the bottom of the trough, the upper edge of the lower skirt portion may be slotted to provide integral anchoring lugs, and the trough built around the upper edge. Alternatively, the trough walls 40,42 could be converging conical segments or could carry inwardly protruding anchors.

In addition, unless the extra strength is needed, the ring stiffener 36 and supporting ring 38 may not be required, and thus a much narrower base plate could be used for the bottom of the trough.

As may therefore be seen, the present invention provides a simple but effective means of securely mounting liquefied gas tanks in the hull of a ship while effectively thermally isolating the tank from the hull. With the present invention, no welding between the skirt portions is required, and since the skirt portions do not mate or actually contact each other, variations in tolerances or dimensions may be accommodated without affecting secure joinder of the two skirt portions.

Although the present invention has been described in terms of the preferred embodiment, this is for the purpose of illustration and not limitation, and it is intended to also claim obvious variations of the present invention, some of which may be apparent immediately, and other only after some study.

Various features of the present invention are disclosed in the following claims.

What is claimed is:

1. In a marine vessel for transporting liquefied gas, a cargo tank for holding the liquefied gas, a support structure for supporting the tank in the hull of the vessel, which support structure includes a two-piece metallic skirt having a first portion connected to the tank and a second portion connected to the hull, annular trough means carried by one of said skirt portions and encircling said tank, the edge of said other skirt portion extending into said annular trough means but being spaced from contact with the walls of said trough means, and hardened material filling said trough means to a level beyond said edge of said other skirt portion to thereby rigidly structurally interconnect said skirt portions and prevent radial movement of one of said skirt portions relative to said other skirt portion.

2. A vessel in accordance with claim 1 in which the hardened material has a thermal conductivity less than said skirt portions.

3. A vessel in accordance with claim 1 in which the hardened material is a polymeric resin.

4. A vessel in accordance with claim 1 in which each skirt portion includes anchors in said hardened material to rigidly interconnect said skirt portions.

5. A vessel in accordance with claim 4 in which said anchors are undercut lugs carried on each of said skirt portions.

6. A vessel in accordance with claim 1 wherein said hardened material is selected from the group consisting of epoxy resins and polyurethane resins.

7. In a marine vessel for transporting liquefied gas, a tank for holding liquefied gas and a two-piece metallic skirt for supporting the tank in the hull of said ship, which metallic skirt has an upper portion connected to the tank and a lower portion connected to the hull, an improvement for joining said skirt portions comprising annular trough means carried atop said lower skirt portion and encircling said tank, said upper skirt portion being annular in shape and including anchoring means extending spatially into said trough but being physically spaced from contact with the walls of said annular trough, and a hardened polymeric resin having a thermal conductivity less than either of said skirt portions filling said annular trough to a level to rigidly embed said anchoring means therein so that movement of said upper annular skirt portion relative to said trough is prevented.

8. The invention in accordance with claim 7 wherein said polymeric resin is selected from the group consisting of epoxy resins and polyurethane resins.

9. A method for mounting a liquefied gas tank having a first skirt portion attached therearound in the hull of a ship, which method comprises affixing a second skirt portion carrying trough means at its upper end at a desired location in the ship hull, lowering the tank so that the bottom edge of said first skirt portion extends spatially into said trough means and stably supporting the tank in a said lowered position with said bottom edge out of physical contact with said trough means, and filling said trough means with a hardenable material to a level above said bottom edge of said first skirt portion.

10. A method in accordance with claim 9 wherein said hardenable material is a mixture of an epoxy resin and a hardener and wherein said supporting is maintained at least until the hardening of said epoxy resin is effected.

* * * * *